United States Patent [19]

Jones-Steele

[11] 4,133,063

[45] Jan. 9, 1979

[54] PORTABLE INFANT LAYETTE

[76] Inventor: Debbie Jones-Steele, 37 Winchester St., Boston, Mass. 02116

[21] Appl. No.: 829,634

[22] Filed: Sep. 1, 1977

[51] Int. Cl.[2] ..... A47D 7/00

[52] U.S. Cl. ..... 5/99 R; 5/335; 5/352

[58] Field of Search ..... 5/93 R, 93 B, 99 R, 5/99 A, 99 B, 99 C, 98 R, 335, 352, 357

[56] References Cited

U.S. PATENT DOCUMENTS

| | | | |
|---|---|---|---|
| 2,626,407 | 1/1953 | Kurry | 5/99 R |
| 2,630,587 | 3/1953 | Brown | 5/335 |
| 2,950,484 | 8/1960 | Jaffe | 5/98 R |
| 3,336,608 | 8/1967 | Lerner | 5/99 R |
| 3,659,297 | 5/1972 | Schutz | 5/93 R |

FOREIGN PATENT DOCUMENTS

| | | | |
|---|---|---|---|
| 510623 | 3/1955 | Canada | 5/93 R |

*Primary Examiner*—Kenneth J. Dorner
*Attorney, Agent, or Firm*—Wolf, Greenfield & Sacks

[57] ABSTRACT

A portable infant changing table includes a pair of articulated mattress sections which may be folded to a more portable, compact configuration. Relatively rigid safety-side board members are attached to the mattress sections and may be raised to an upright configuration when the device is in use. The device also includes one or more pockets at the outwardly facing surfaces of the mattress sections to facilitate carrying of baby-related articles.

7 Claims, 6 Drawing Figures

50
10'
53
52
54
39
50
54
51
55
53
52
24
54
54

PORTABLE INFANT LAYETTE

BACKGROUND AND SUMMARY OF THE INVENTION

This invention relates to improvements and infant and baby accessories and, particularly, to an improved portable infant mattress device which may be used as a changing table, as a bed or the like.

Traveling with small children or infants often entails carrying a wide variety of paraphernalia for the child's needs. This is the case particularly with infants where it is desirable to have a comfortable surface on which the baby's diapers may be changed as well as other related equipment which often is carried in separate bags, at some inconvenience. It is among the general objects of the invention to provide an improved mattress-like device which may be folded to a compact configuration and which is ideally suited for travel as well as in situations where storage space is at a premium and it is desirable to have a compactable device.

In brief, the invention includes a pair of mattress sections which are hinged to each other so that they may be folded between a compact, portable or an opened, flat configuration. The mattress sections include relatively rigid side boards which are hinged to the mattress sections and which can be folded to an upright configuration which, when the mattress is opened, serves to define a pair of parallel safety side rails. The outwardly facing sides of the mattress sections include means defining enlarged pockets in which various child-related articles and accessories may be conveniently carried. The top of the mattress surface (when opened to its flat configuration) is defined by a detachable top sheet which may be rubberized or otherwise made waaterproof. Ties are provided to secure the folded-up mattress sections in their portable, compact configuration which also enables the device to be carried in a suitcase-like manner.

It is among the objects of the invention to provide an improved portable child's mattress and accessory carrier.

Another object of the invention is to provide a device of the type described having integral rigid side boards which do not interfere with the compact and portable nature of the device.

A further object of the invention is to provide a device of the type described having pockets in which child-related accessories and paraphernalia may be carried conveniently.

BRIEF DESCRIPTION OF THE DRAWINGS

The foregoing and other objects and advantages of the invention will be understood more fully from the following further detailed description thereof, with reference to the accompanying drawings wherein.

DESCRIPTION OF THE PREFERRED EMBODIMENTS

Figure 3:
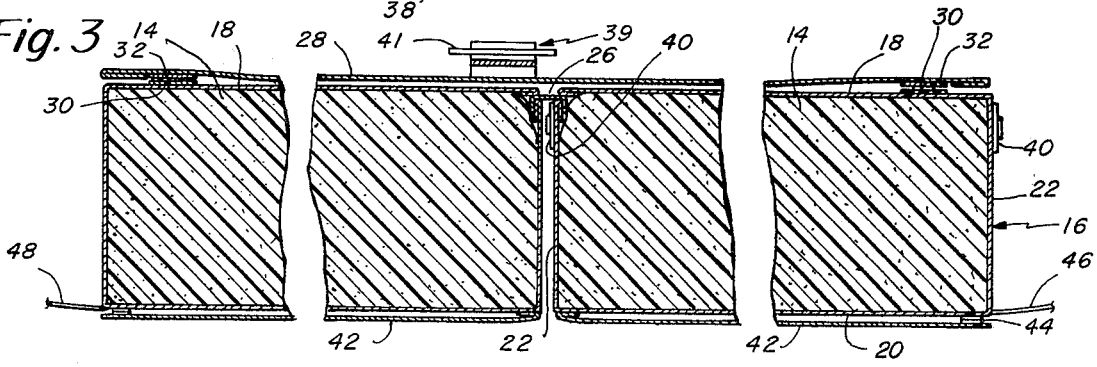
FIG. 3 is a sectional illustration of the device as seen along the line 3—3 of FIG. 2.
Figure 4:
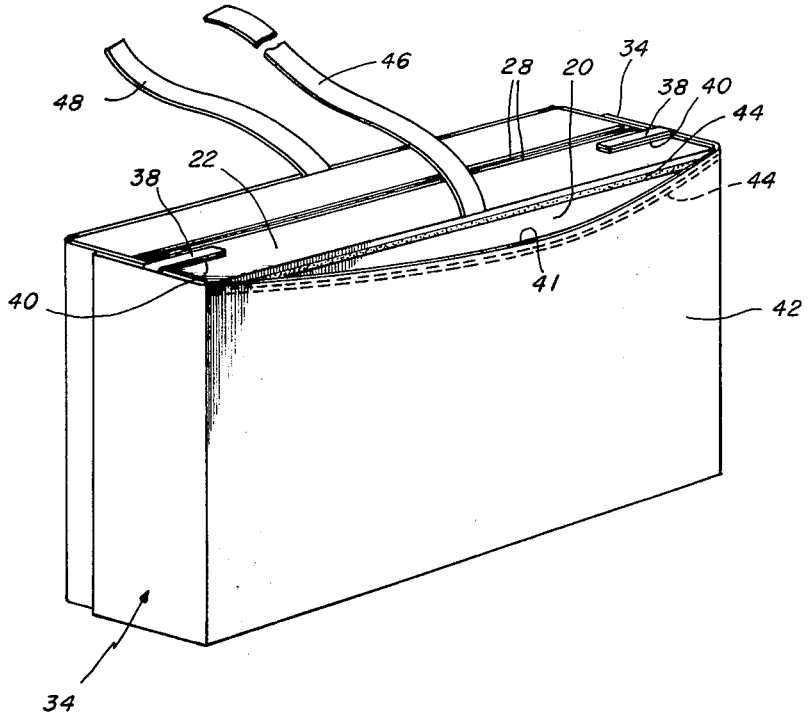
FIG. 4 is an illustration of the device when folded to its compact configuration and showing the accessory pocket on one side.

As shown in the drawings, the device includes a pair of mattress sections indicated generally by the reference characters 10, 12. Each of the mattress sections is generally rectangular and includes an inner core 14 (FIG. 3) which preferably is formed from a resilient foam material such as rubber or plastic. Each of the foam cores 14 is encased within a fabric mattress covering, indicated generally at 16, which includes a top panel 18, a bottom panel 20, a pair of end panels 22 and a pair of side panels 24. The mattress cover 16 may be formed in any of a variety of conventional sewing or equivalent techniques. The mattress sections 10, 12 are disposed adjacent each other and are hinged together along a hinge line which extends along the adjacent side edges of the top panels 18. As shown in FIG. 3, the hinge may comprise an elongate fabric web 26 which is stitched to the juncture of each of the adjacent top and end panels 18, 22.

The top panels 18, which define the supporting surface when the device is laid open, are covered by a top sheet 28. The top sheet 28 is detachably connected to the top panels 18 so that it may be cleaned separately or replaced. Top sheet 28 preferably includes a comfortable fabric upper surface and may be rubberized or otherwise coated or impregnated so as to protect the underlying mattress sections from liquid, stains or the like. The top sheet 28 is attached to the upper panels 18 of the mattress cover 16 by a plurality of fastener elements indicated generally at 30. In the embodiment shown, the fastener elements 30 comprise snap tabs which are secured to strips 32 which, in turn, are sewn to each of the top panels 18 and cover sheet 28 along their respective peripheries.

Figure 1:
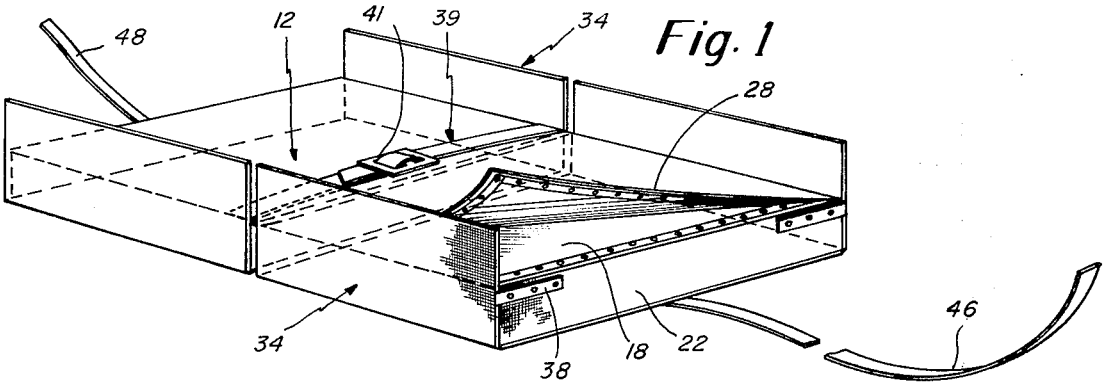
FIG. 1 is a perspective illustration of one embodiment of the invention in its opened configuration and with its side boards raised.
Figure 2:
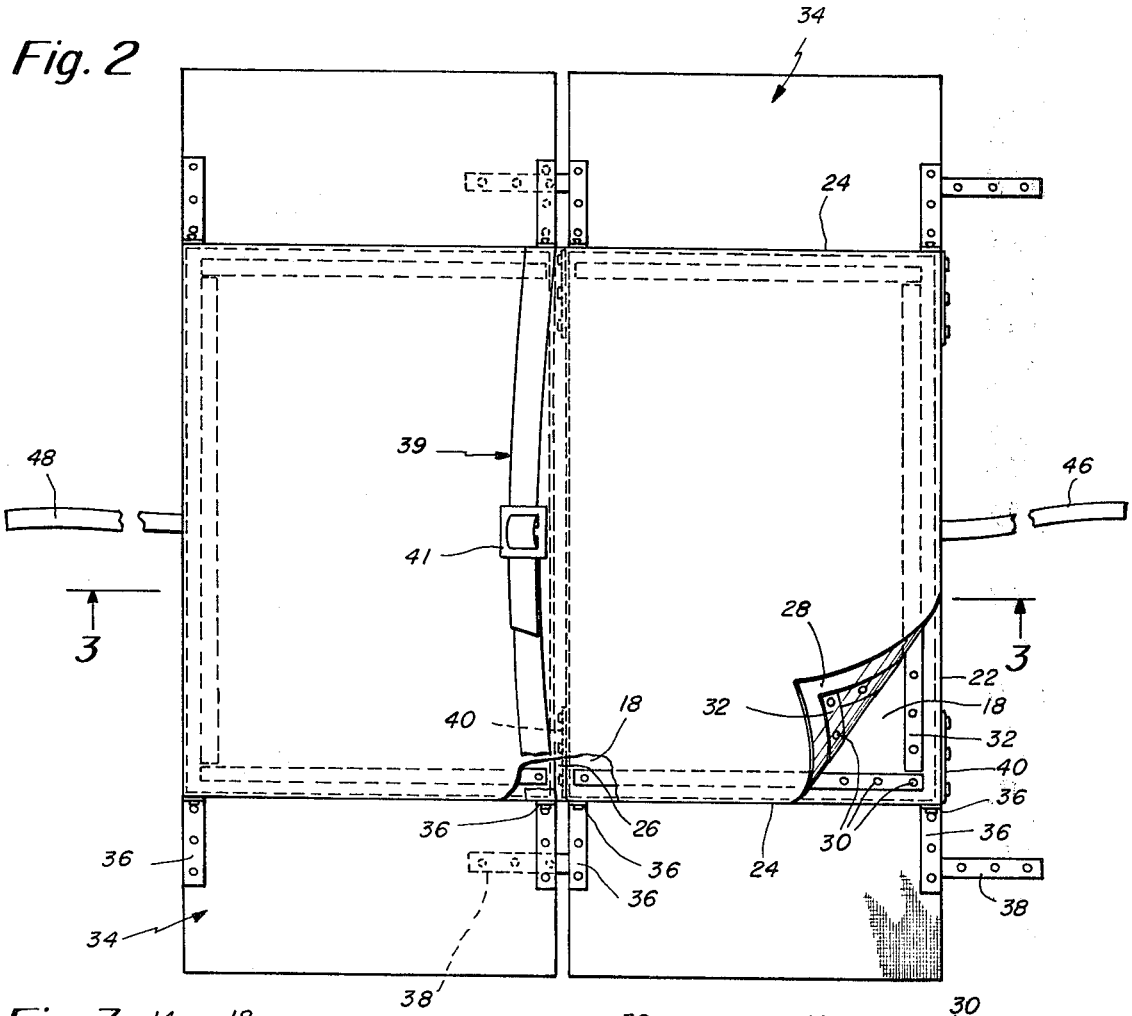
FIG. 2 is a plan view of the device in its opened configuration with the side board lowered.

The device also includes a number of relatively rigid side board elements, indicated generally at 34 which are attached to the mattress covers 16 from the juncture of the bottom panel 20 and side panel 24. Each side board element 34 may comprise, for example, an envelope formed from the same fabric as that from which the mattress cover is made, with a relatively rigid board 36 inserted therein. The side boards are formed in sections, each section being of a length substantially corresponding to that of its associated side panel 24. The side boards are of a height which is approximately equal to twice that of the thickness of each mattress section 16 so that when the device is open and the boards are raised (from their configuration shown in FIG. 2) to the upright configuration shown in FIG. 1, they will provide a pair of parallel, protective side rails extending along the longitudinal sides of the opened device.

Means are provided for securing the side boards 34 in their upright configuration. In the embodiment shown in FIGS. 1–5, a strip of detachable snap fasteners may be attached to each of the opposite ends of the side boards 34, to engage with a corresponding series of fasteners attached to the end walls of the mattress cover 16, as suggested at 36 in FIG. 2. Alternatively, or in addition thereto, connective strips 38 carrying such snap fasteners may be attached to the ends of the side boards 34 and a corresponding strip of fasteners 40 may be secured to the end walls 22 of the mattress covers 16. In the preferred embodiment, at least one opposed pair of side boards 34 is provided with the strips 38, which also facilitate securing the device in the closed, portable position as will be described.

If desired, a supplemental safety strap, indicated at 39, may be provided. The safety strap 39 preferably is located adjacent to and generally parallels the hinge line defined by the web 26. Its ends are stitched securely to the side panels 24 and its inner ends may be secured, adjustably, by an appropriate buckle 41.

In the embodiment shown in FIGS. 1–5, each of the four side board segments is attached independently to its associated section of its mattress cover. Other configurations, however, may be employed such as that suggested in FIG. 6 in which one of the side boards is hingedly attached directly to the adjacent end of its adjacent side board and has no permanent attachment to the other of the mattress sections. In that configuration, one of the mattress sections 10' is provided with a first side board member 50 hingedly attached along its lower edge 51 to the lower portion of each of the sides 24 of that mattress section 10'. A second side board member 52 is hingedly attached, end-to-end, to each of the first side board members 50, as by stitching along a hinge line 53. The first and second side board members 50, 52 are of substantially the same dimensions as to enable the second side board members 52 to be folded between the first side board members 50 and the sides 24 of the mattress sections as suggested by the arrow 55 in FIG. 6. FIG. 6 also illustrates the use of ties 54 by which the side boards 50, 52 may be secured in an open or folded-up configuration. It may be noted that with the FIG. 6 configuration, the side boards extend continuously along the length of the opened device as compared with the configuration of FIGS. 1–5 in which there is a small space between the adjacent ends of adjacent side boards. Each embodiment provides satisfactory results.

In order to facilitate convenient storage and carrying of the variety of infant paraphernalia which is typically required, the device includes a pair of accessory pockets formed on the lower or outer surface of each of the mattress covers. To this end, a rectangular pocket panel 42 made from a like fabric is stitched along three sides to the lower panel 20 of one or both of the mattress covers. One of the edges, preferably the outer edge 41 of the pocket panel 42 remains unstitched and has an appropriate fastener element, such as the "Velcro" type of fastener strip 43 extending along the length of the open edge. The facing portion of the lower panel 20 is provided with a cooperative Velcro strip 45. The accessory pocket defined may be easily opened or closed and provides a convenient location in which to carry and store the various desired accessories. The device also includes elongate ties 46, 48 which are attached to and extend from the end walls 22 of the mattress covers 16.

Figure 5:
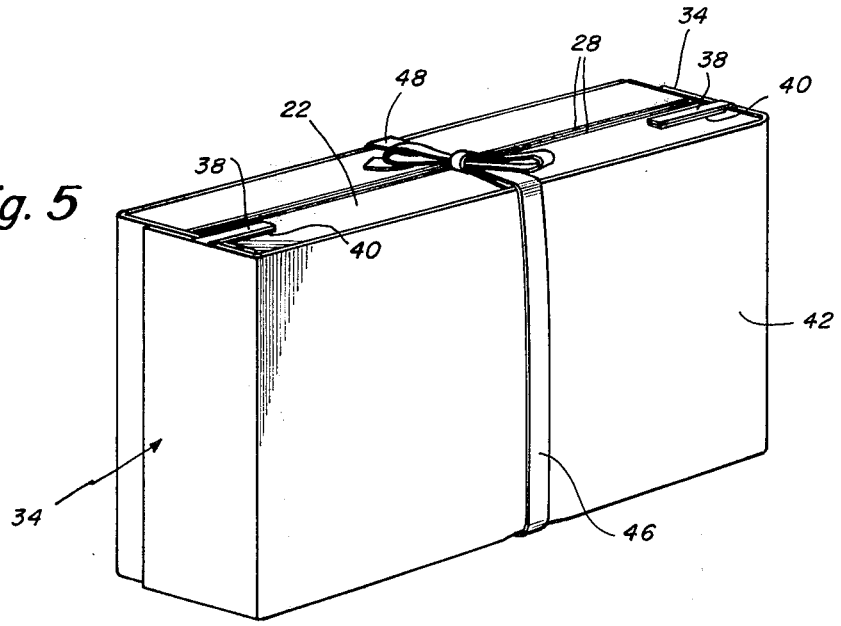
FIG. 5 is an illustration of the device when fully closed and tied in its easily-carried portable configuration.
Figure 6:
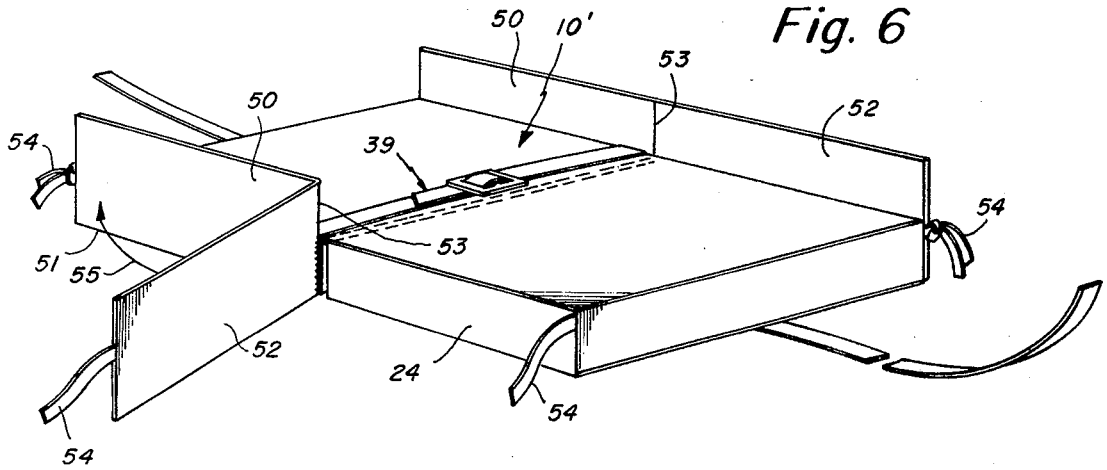
FIG. 6 is an illustration of a modified embodiment of the invention, showing one pair of side boards opened and the other pair closed.

FIG. 5 illustrates the device in its folded up, compacted configuration from which it may be seen that the side boards 34 associated with one of the mattress sections are tucked into the region between the other mattress section and its side boards. The other mattress section, being provided with the fastener strips 38, may be secured firmly by the fastener strips 38 which holds the side board sections 34 firmly against the ends of the package in a flat, compact configuration. The ties 46, 48 may be simply wrapped about the folded-up device and tied, as shown, to enable it to be carried in a manner similar to that of a suitcase. The embodiment shown in FIG. 6 folds up in a similar manner except that the side boards 50, 52 fold up in the manner suggested in FIG. 6.

Thus, I have described an improved portable mattress device suited particularly for use with infants which may be used as a changing table or a sleeping pad and which provides a high degree of convenience. It should be understood, however, that the foregoing description of the invention is intended merely to be illustrative thereof and that other modifications and embodiments thereof may be apparent to those skilled in the art without departing from its spirit.

Having thus described the invention, what I desire to claim and secure by Letters Patent is:

1. A portable mattress device comprising:

a pair of substantially rectangular mattress sections, each of the mattress sections having a top portion, a bottom portion, two sides and two ends, said mattress sections being hinged to each other along adjacent ends at the edges defined by the top portions and said adjacent ends of the mattress sections, to enable the mattress sections to be hinged toward and away from each other between a face-to-face configuration and a flat configuration;

side board means hingedly attached to the lower edges of the sides of at least one of the mattress sections, said side board means being hingeable to an upright configuration in which the side board means extends along the side of the mattress and substantially above the top of its associated mattress section, said side board means being of a length substantially equal to the combined length of the sides of the mattress sections when in a flat configuration thereby to define longitudinally extending side rails;

said side board means being of a height which is substantially double that of the thickness of one of the mattress sections; and means for securing said side board means in said upright configuration.

2. A device as defined in claim 1 wherein said side board means includes a side board member attached to the lower edge of each said side of each mattress section, said side board members being independent of each other.

3. A device as defined in claim 1 wherein the side board means comprises a first side board member attached to the lower edge of each side of one of the mattress sections, said first side board member being of a length substantially corresponding to that of said side of said mattress section;

an second side board member hingedly attached to an end of each of the first side board members in continuous, end-to-end relation, said second side board members being free of any permanent attachment to the mattress sections.

4. A portable mattress device as defined in claim 1 further comprising:

a substantially rectangular top sheet constructed to overlie the top of the mattress sections; and means for detachably connecting the periphery of the top sheet to the periphery of the top of the mattress sections.

5. A device as defined in claim 1 further comprising:

means defining an accessory pocket at the surface defining the bottom of at least one of the mattress sections.

6. A device as defined in claim 1 wherein the means for securing the side board means in said upright configuration comprises:

each of the side board means and the adjacent portions of the mattress section being provided with detachable fastener elements.

7. A device as defined in claim 1 further comprising an adjustable safety strap secured at its outer ends to opposite ends of said mattress sections, said safety strap being disposed adjacent to and extending generally parallel to the hinged juncture of the mattress sections.

* * * * *